US007703666B2

(12) United States Patent
Hand et al.

(10) Patent No.: US 7,703,666 B2
(45) Date of Patent: Apr. 27, 2010

(54) CARTON WITH DISPENSER

(75) Inventors: Graham Hand, Roswell, GA (US); Andrea Coltri-Johnson, Acworth, GA (US); Raymond Rudolph Spivey, Sr., Mableton, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 846 days.

(21) Appl. No.: 11/416,843

(22) Filed: May 3, 2006

(65) Prior Publication Data

US 2006/0255114 A1 Nov. 16, 2006

Related U.S. Application Data

(60) Provisional application No. 60/677,211, filed on May 3, 2005.

(51) Int. Cl.
*B65D 17/00* (2006.01)

(52) U.S. Cl. ..... 229/242; 229/122

(58) Field of Classification Search ..... 229/242, 229/103.2, 117.15, 240, 241; 206/177, 139, 206/736, 141, 155; 221/302
See application file for complete search history.

(56) References Cited

U.S. PATENT DOCUMENTS

| | | | | |
|---|---|---|---|---|
| 2,115,673 | A | | 4/1938 | Stompe |
| 2,294,965 | A | * | 9/1942 | Davidson ..... 206/45.21 |
| 2,297,284 | A | * | 9/1942 | Blackman ..... 206/139 |
| 3,178,242 | A | | 4/1965 | Ellis et al. |
| 3,356,279 | A | | 12/1967 | Root |
| 4,396,143 | A | | 8/1983 | Killy |
| 4,417,655 | A | | 11/1983 | Forbes, Jr. |
| 4,577,762 | A | | 3/1986 | Kuchenbecker |
| 4,890,440 | A | | 1/1990 | Romagnoli |
| 4,949,845 | A | | 8/1990 | Dixon |
| 4,974,771 | A | | 12/1990 | Lavery |
| 5,072,876 | A | * | 12/1991 | Wilson ..... 229/103.2 |
| 5,137,211 | A | | 8/1992 | Summer et al. |
| 5,246,112 | A | | 9/1993 | Stout et al. |
| 5,505,372 | A | * | 4/1996 | Edson et al. ..... 229/121 |
| 5,622,309 | A | | 4/1997 | Matsuda et al. |
| 5,664,683 | A | | 9/1997 | Brody |
| 5,690,213 | A | | 11/1997 | Matsumura |
| 5,704,470 | A | | 1/1998 | Sutherland |
| 5,826,783 | A | | 10/1998 | Stout |
| 5,875,961 | A | | 3/1999 | Stone et al. |

(Continued)

FOREIGN PATENT DOCUMENTS

EP 0 475 147 A1 3/1992

(Continued)

*Primary Examiner*—Nathan J Newhouse
*Assistant Examiner*—Christopher Demeree
(74) *Attorney, Agent, or Firm*—Womble Carlyle Sandridge & Rice, PLLC

(57) ABSTRACT

A carton for containing a plurality of articles. The carton has panels that extend at least partially around an interior of the carton. The panels comprise a top panel, a bottom panel and a first side panel and a second side panel. The carton has a dispenser for allowing access to the articles in the carton. The dispenser has a dispenser panel that is at least partially defined by a tear line in the carton and is for being at least partially removed for at least further opening a dispenser opening.

30 Claims, 11 Drawing Sheets

U.S. PATENT DOCUMENTS

| | | | | |
|---|---|---|---|---|
| 5,921,398 | A | 7/1999 | Carroll | |
| 5,924,559 | A | 7/1999 | Carrel et al. | |
| 6,176,419 | B1 | 1/2001 | Holley, Jr. | |
| 6,409,077 | B1 | 6/2002 | Telesca et al. | |
| 6,631,803 | B2 | 10/2003 | Rhodes et al. | |
| 6,715,639 | B2 | 4/2004 | Spivey | |
| 6,752,262 | B1 | 6/2004 | Boriani et al. | |
| 6,866,186 | B2 | 3/2005 | Fogle et al. | |
| 2002/0070139 | A1 | 6/2002 | Bates | |
| 2002/0088820 | A1 | 7/2002 | Spivey | |
| 2002/0088821 | A1 | 7/2002 | Spivey et al. | |
| 2003/0192905 | A1 * | 10/2003 | Spivey | 221/255 |
| 2004/0060972 | A1 | 4/2004 | Harrelson | |
| 2004/0099558 | A1 | 5/2004 | Oliff et al. | |
| 2006/0102706 | A1 * | 5/2006 | Spivey et al. | 229/122 |

FOREIGN PATENT DOCUMENTS

| | | | |
|---|---|---|---|
| EP | 1 262 417 | A2 | 12/2002 |
| FR | 2 549 010 | A1 | 1/1985 |
| FR | 2 581 970 | | 11/1986 |
| WO | WO 96/29260 | | 9/1996 |
| WO | WO 99/64301 | | 12/1999 |
| WO | WO 02/30785 | A1 | 4/2002 |
| WO | WO 2004/043790 | A2 | 5/2004 |

* cited by examiner

CARTON WITH DISPENSER

CROSS-REFERENCE TO RELATED APPLICATIONS

This application claims the benefit of U.S. Provisional Application No. 60/677,211, filed on May 3, 2005, the entire contents of which are hereby incorporated by reference as if presented herein in their entirety.

BACKGROUND OF THE INVENTION

The present invention generally relates to cartons for holding and dispensing beverage containers or other types of articles. More specifically, the present invention relates to cartons having a dispenser for dispensing articles from the carton.

Enclosed cartons with dispensing features have been used in the past. Many such cartons allow for the creation of dispenser openings by providing dispenser portions demarcated by tear lines. The dispenser portions can be wholly or partially separated from the carton to create an opening from which articles can be removed from the carton. Many conventional dispenser openings, however, are positioned such that the removable dispenser panel prevents the carton from being easily carried after the dispenser panel has been removed.

SUMMARY OF THE INVENTION

In general, one aspect of the invention is directed to a carton for containing a plurality of articles. The carton comprises panels that extend at least partially around an interior of the carton. The panels comprise a top panel, a bottom panel and a first side panel and a second side panel, and a dispenser allowing access to the articles in the carton. The dispenser comprises a dispenser panel that is at least partially defined by a tear line in the carton and is for being at least partially removed for at least further opening a dispenser opening. The tear line comprises a first portion in the top panel extending between the first and second side panels, a second portion in the first side panel, and a third portion in the second side panel, with at least one of the second and third portions of the tear line being oblique relative to the top panel.

In another aspect, the present invention is generally directed to a blank for forming a carton having a dispenser for dispensing articles from the carton. The blank comprises a plurality of panels comprising a top panel, a bottom panel, a first side panel and a second side panel, and a dispenser panel at least partially defined by a tear line in the blank. The dispenser panels is at least partially separable from the blank along the tear line to form an opening of the dispenser. The tear line comprises a first portion that is in the top panel and extends between the first and second side panels, a second portion in the first side panel, and a third portion in the second side panel, with at least one of the second and third portions of the tear line being oblique relative to the top panel.

Other aspects, features, and details of the present invention can be more completely understood by reference to the following detailed description of exemplary embodiments taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present invention generally relates to opening and dispensing features for cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present invention can accommodate articles of any shape. For the purpose of illustration and not for the purpose of limiting the scope of the invention, the following detailed description describes beverage containers (e.g., glass beverage bottles) as disposed within the carton embodiments. In this specification, the terms "lower," "bottom," "upper" and "top" indicate orientations determined in relation to fully erected and upright cartons.

Figure 1:
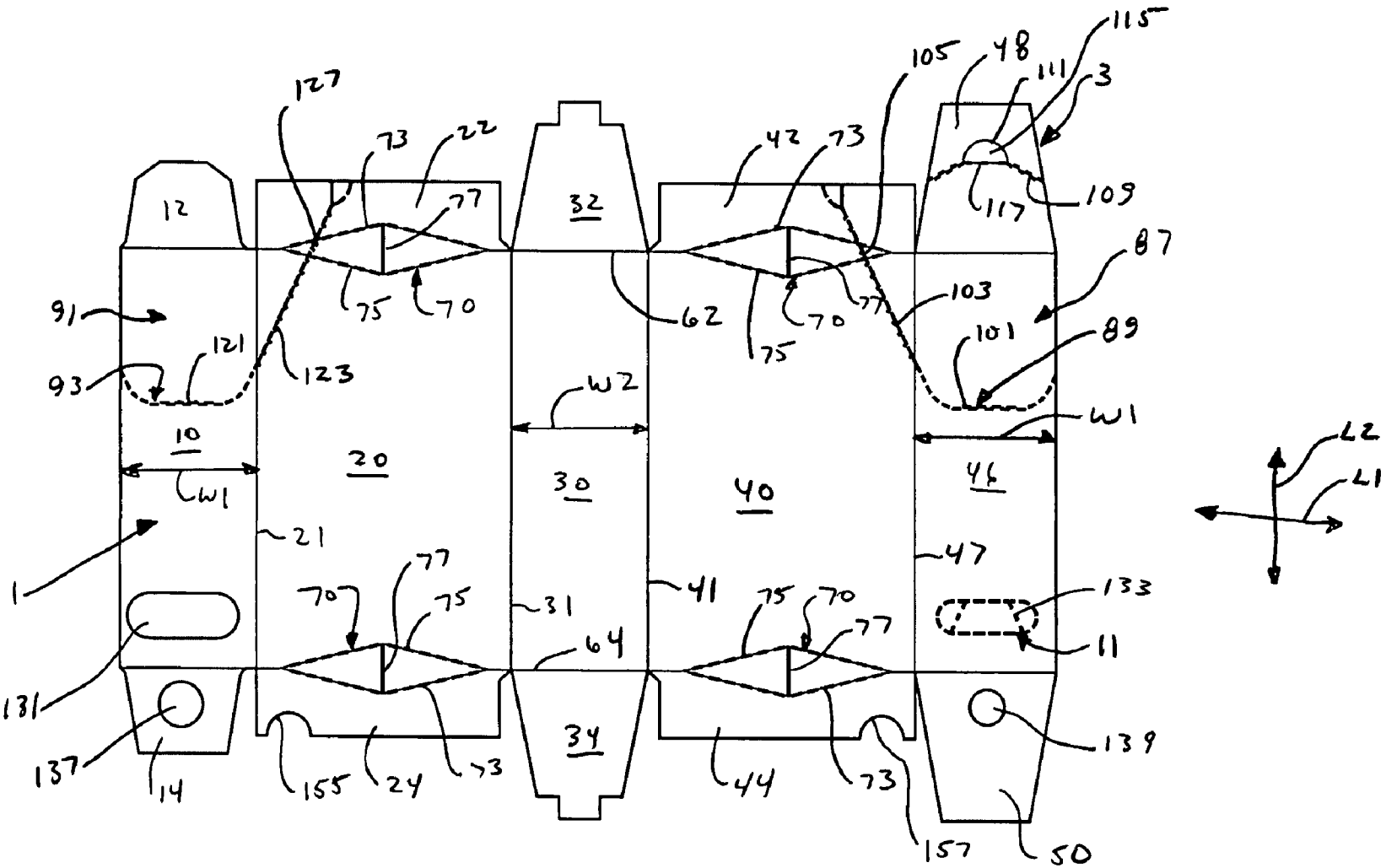
FIG. 1 is a plan view of a blank used to form a carton according to a first embodiment of the invention.
Figure 2:
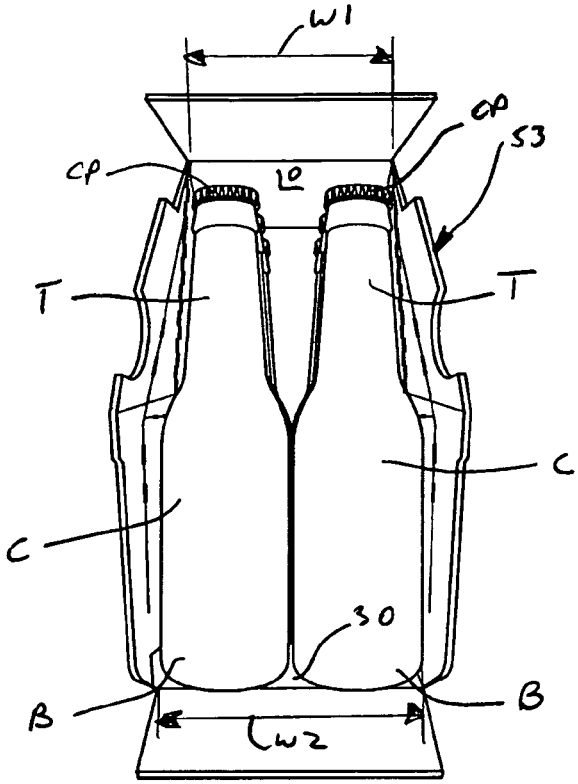
FIG. 2 is an end view of a first open end of a carton formed from the blank of FIG. 1.
Figure 3:
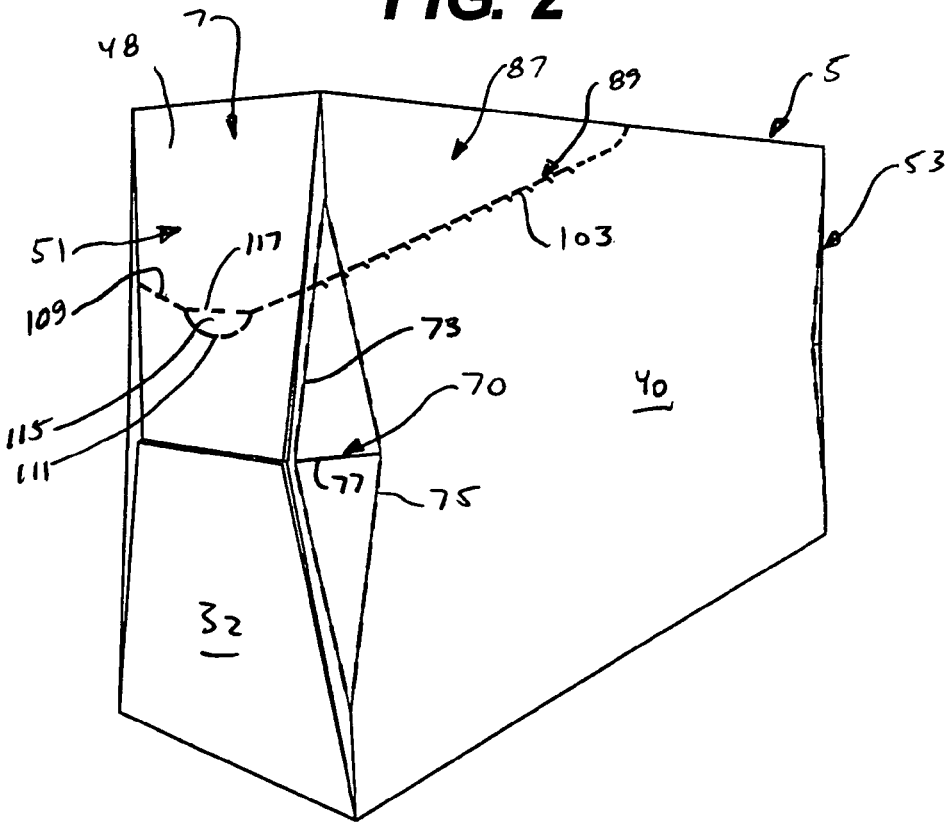
FIG. 3 is a perspective of the assembled and closed carton.
Figure 4:
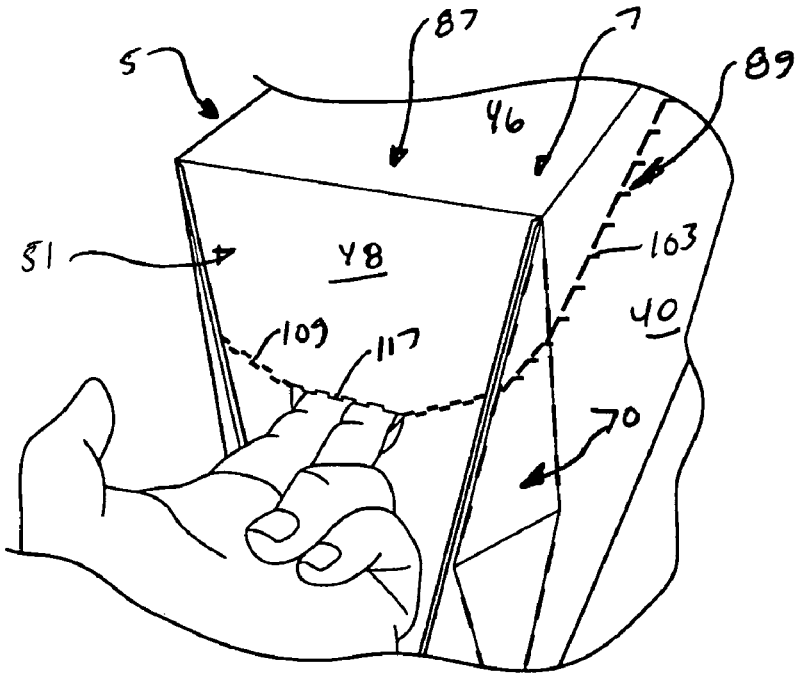
FIG. 4 is a perspective of a portion of the carton showing a dispenser panel activated.

FIG. 1 is a plan view of the exterior side 1 of a blank, generally indicated at 3, used to form a carton 5 (FIG. 3) according to the exemplary embodiment of the invention. The carton 5 can be used to house a plurality of articles such as containers C (FIG. 2). The carton 5 has a dispenser, generally indicated at 7 (FIG. 3), formed in the carton for allowing access to the containers C. In the illustrated embodiment, the containers C are bottles having a wide bottom B and a narrow top T including a cap CP. In the illustrated embodiment, the carton 5 is sized to house containers C in a single layer in a 2×6 arrangement, but it is understood that the carton 5 may be sized and shaped to hold containers of a different or same quantity in more than one layer and/or in different row/column arrangements (e.g., 1×6, 3×6, 2×6×2, 3×4×2, 2×9, 3×4, etc.). In the illustrated embodiment, the carton 5 includes a handle, generally indicated at 11 (FIG. 8), for grasping and carrying the carton.

The blank 3 has a longitudinal axis L1 and a lateral axis L2. In the illustrated embodiment, the blank 3 comprises a first top panel 10 foldably connected to a first side panel 20 at a first lateral fold line 21, a bottom panel 30 foldably connected to the first side panel 20 at a second lateral fold line 31, a second side panel 40 foldably connected to the bottom panel 30 at a third lateral fold line 41, and a second top panel 46 foldably connected to the second side panel 40 at a fourth lateral fold line 47.

The first top panel 10 is foldably connected to a first top end flap 12 and a second top end flap 14. The first side panel 20 is foldably connected to a first side flap 22 and a second side flap 24. The bottom panel 30 is foldably connected to a first bottom end flap 32 and a second bottom end flap 34. The second side panel 40 is foldably connected to a first side flap 42 and a second side flap 44. The second top panel 46 is foldably connected to a first top end flap 48 and a second top end flap 50. When the carton 5 is erected, the end flaps 12, 32, 48 and side flaps 22 and 42 close a first end 51 of the carton, and the end flaps 14, 34, 50 and side flaps 24 and 44 close a second end 53 of the carton. In accordance with an alternative embodiment of the present invention, different flap arrangements can be used for closing the ends 51, 53 of the carton 5.

The end flaps 12, 32, and 48 and side flaps 22 and 42 extend along a first marginal area of the blank 1, and are foldably connected at a first longitudinal fold line 62 that extends along the length of the blank. The end flaps 14, 34, and 50 and side flaps 24 and 44 extend along a second marginal area of the blank 1, and are foldably connected at a second longitudinal fold line 64 that also extends along the length of the blank. The longitudinal fold lines 62, 64 may be, for example, substantially straight, or offset at one or more locations to account for blank thickness or for other factors.

The blank 3 includes four diamond-shaped corners, generally indicated 70. Two diamond-shaped corners 70 are formed in the first side panel 20 and cooperate with the respective longitudinal fold line 62, 64 to foldably connect the first and second side panels 22, 24 to the first side panel. Two diamond-shaped corners 70 are formed in the second side panel 40 and cooperate with respective longitudinal fold lines 62, 64 to foldably connect the first and second side panels 42, 44 to the second side panel. In the embodiment of FIG. 1, each diamond-shaped corner 70 comprises opposed v-shaped fold lines 73, 75 that connect to a respective longitudinal fold line 62, 64 at pointed corners of each diamond-shaped corner. The diamond-shaped corners 70 are defined in part by transverse fold lines 77 that connecting each of the v-shaped fold lines 73, 75. As set forth below in more detail, the diamond-shaped corners 70 allow the first side panel 20 and second side panel 40 to angle inward towards the interior of the carton 5 so that the carton forms a tight fit around the containers C housed in the carton. In an alternative embodiment, the diamond-shaped corners 70 may be omitted.

Figure 5:
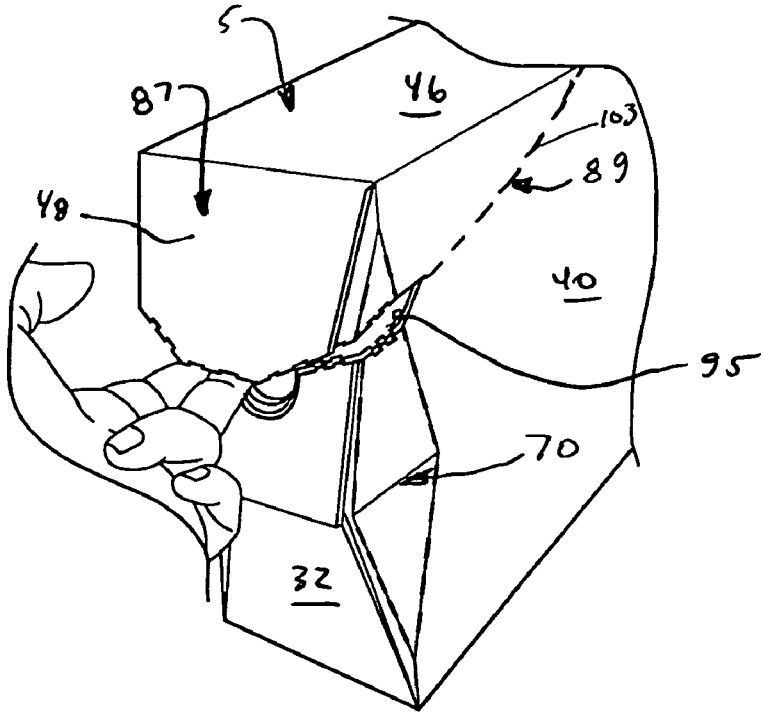
FIG. 5 is a perspective showing the dispenser panel partially opened.
Figure 6:
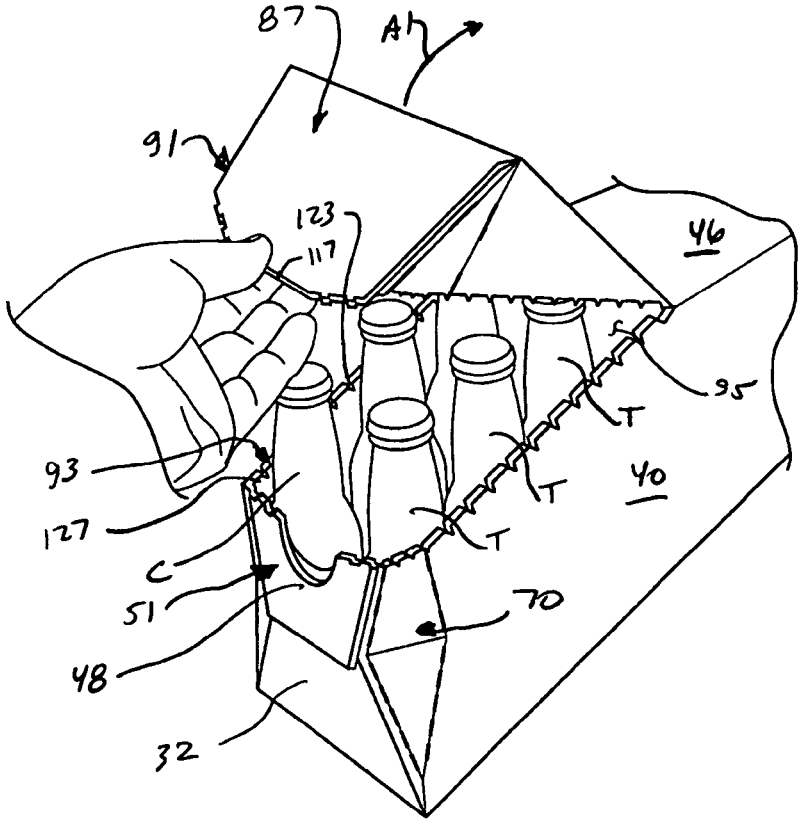
FIG. 6 is a perspective showing the dispenser panel further opened.
Figure 7:
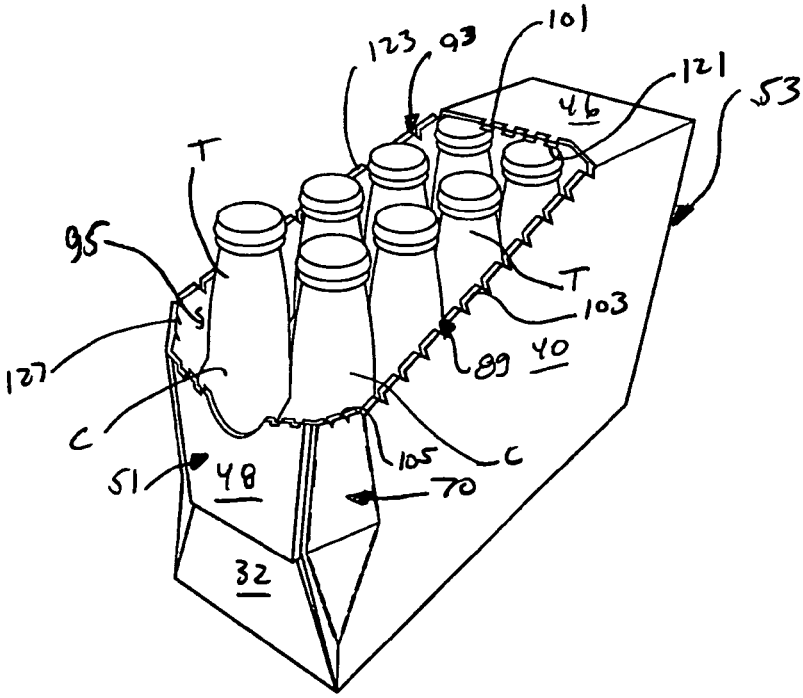
FIG. 7 is a perspective showing the dispenser panel fully opened and removed from the carton.

The dispenser 7 includes a first dispenser panel 87 removably attached to the blank 3 at a first tear line, generally indicated at 89, and a second dispenser panel 91 removably attached to the blank at a second tear line, generally indicated at 93. As shown in FIGS. 5-7, first dispenser panel 87 and second dispenser panel 91 are separated from the assembled carton 5 at the first and second tear lines 89, 93 to form an opening 95 in the carton 5 to allow containers C to be removed from the carton. In the illustrated embodiment, the first tear line 89 includes a first portion 101 in the second top panel 46, a second portion 103 that is in the second side panel 40 and is oblique to the second top panel 46, a third portion 105 passing through the diamond-shaped corner 70 in the second side panel and extending into the side flap 42, and a fourth portion 109 in the top end flap 48. The fourth portion 109 of the first tear line 89 includes a curved portion 111 in the top end flap 48. The curved portion 111 forms a finger panel 115 at the lower edge of the dispenser panel 87. The finger panel 115 is foldably connected to the dispenser panel 87 by a fold line 117 that segregates the fourth portion 109 of the tear line 89 and extends between the two ends of the curved tear line 11. The second tear line 93 includes a first portion 121 in the first top panel 10, a second portion 123 that is in the first side panel 20 and is oblique to the first top panel, and a third portion 127 passing through the diamond-shaped corner 70 in the first side panel 20 and extending into the side flap 22. It is understood that the dispenser panels 87, 91 could comprise other shapes and could include other panels or side and end flaps of the blank 3 without departing from the scope of this invention.

Figure 8:
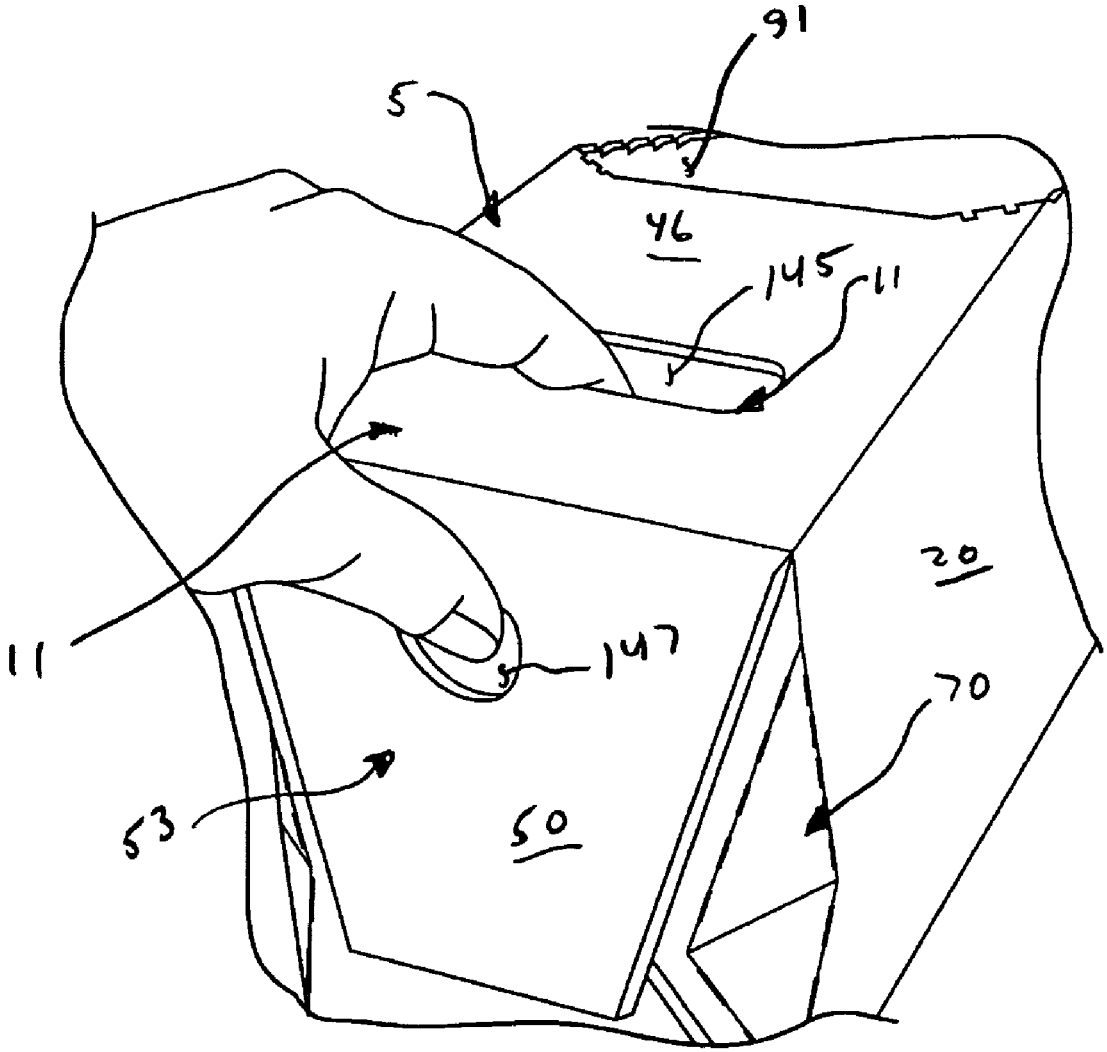
FIG. 8 is a perspective showing the dispenser panel opened and a handle activated.

As shown in FIG. 1, the handle 11 of the carton 5 includes a first elongate handle flap 131 formed in the first top panel 10, a second elongate handle flap 133 formed in the second top panel 46, a first circular handle flap 137 formed in the top end flap 14, and a second circular handle flap 139 formed in the end flap 50. As shown in FIG. 8, the first and second elongate handle flaps 131, 133 are positioned in the blank 3 so that the flaps overlap in the assembled carton 5 so that the handle 11 may be activate by pressing on the handle flaps and folding the handle flaps down to form an opening 145 in the carton. The opening 145 is shaped for insertion of a users fingers during grasping of the carton 5. The first and second circular handle flaps 137, 139 are positioned in the blank 3 so that the flaps overlap in the assembled carton 5 so that the handle 11 may be activated by pressing on the circular flaps and folding the circular flaps inward to form an opening 147 in the carton. The opening 145 is shaped and located for insertion of a users thumb during grasping of the carton 5. In the illustrated embodiment, the handle 11 includes respective curved cutouts 155, 157 in the end flaps 24, 44 that accommodate the circular handle flaps 137, 139 that are folded inward to activate the handle. The overlapped first and second elongate handle flaps 131, 133 and overlapped first and second circular handle flaps 137, 139 form the handle 11 at the second closed end 53 of the carton 5. It is understood that the handle flaps 131, 133, 137, 139 could have other shapes and/or that only a single handle flap may be formed in the blank 3 without departing from the scope of this invention.

In accordance with the exemplary embodiment, the blank 3 can be erected into the carton 5 by folding along fold lines 21, 31, 41, 47, and adhering the first top panel 10 to the second top panel 46 to form a sleeve. It is understood that the blank 3 may be otherwise configured to have only one top panel or could have more than one bottom panel without departing from the scope of this invention. In the illustrated embodiment, the first end 51 of the carton 5 is closed by respectively overlapping and adhering the end flaps 12, 32, 48 and side flaps 22, 42 after the containers C are inserted into the carton. The second end 53 of the carton 5 is closed by respectively overlapping the end flaps 14, 34, 50 and side flaps 24, 44. Once the blank 3 is formed into a sleeve, the containers C may be loaded in the carton 5 from the first end 51 and then the first end may be closed by overlapping and gluing the end flaps 12, 32, 48 and side flaps 22, 42.

The carton 5 of the present invention is shaped to hold bottles C in an upright position such that the bottom B of the bottles is supported by the bottom panel 30 and the top portion T of the bottles is in contact with or adjacent to the overlapped first and second top panels 10, 46. The bottom panel 30 has a width W2 greater than a width W1 of the first and second top panels 10, 46 so that the side walls 20, 40, of the assembled carton 5 are inwardly tapered such that the bottom of each side wall contacts the bottom B (FIG. 2) of a respective container C and the top of each side wall contacts the cap CP of a respective container. The diamond-shaped corners 70 of the carton 5 allow the top portion of each sidewall 20, 40 to be angled inward so that the carton 5 is more narrow at the top where the side walls connect with the top walls 10, 46 than at the bottom where the side walls connect with the bottom panel 30. This narrowing of the width of the carton 5 from the bottom to the top provides two points of contact of the side walls 20, 40 with the bottles C to hold both the top T and the bottom B of the bottles in a relatively fixed position to prevent movement of the bottles in the carton.

In one exemplary embodiment and as best understood with reference to FIG. 2, the width W1 of the first and second top panel 10, 46 is approximately 4.6 inches (117 mm) and the width W2 of the bottom panel 30 is approximately 4.8 inches (122 mm). In general, the ratio of the width W1 of the top panel 10, 46 to the width of the bottom panel can range from approximately 0.7 to 1 but it is understood that this ratio will be based on the geometry of the container C housed in the carton.

The first dispenser panel 87 and the second dispenser panel 91 are overlapped in the assembled carton 5 so that the dispenser 5 is opened by separating the first and second dispenser panels along the tear lines 89, 93. As shown in FIGS. 4-7, an exemplary opening process can begin with pressing against the finger panel 115 to tear the dispenser panel 87 along the curved tear line 111 and folding the finger panel inward along fold line 117. Once the finger panel 115 is folded inward, the dispenser panels 87, 91 are grasped and pulled in the direction of arrow A1 (FIG. 6) to tear the carton 5 along the tear lines 89, 93. As shown in FIG. 7, the dispenser panels 87, 91 may be removed from the carton 5 by completely tearing the panels along the tear lines 89, 93. Containers C are positioned in the upright position in the carton 5 so that the removal of the dispenser panels 87, 91 exposes the top portion T of the containers for grasping by a user to selectively remove a container through the opening 95 in the carton 5. It is understood that the dispenser 7 may be otherwise sized and shaped to correspond with various other sizes and shapes of containers C which may be housed in the carton 5, and to form other sizes and locations of the opening. For example, the two dispenser panels 87, 91 and two tear lines 89, 93 could be combined or replaced with a single dispenser panel and tear line without departing from the scope of this invention.

As shown in FIG. 8, the handle 11 may be used to grasp the carton 5 by pressing against the overlapped first and second elongate handle flaps 131, 133 to create the elongate opening 145 in the top panels 10, 46 generally adjacent the second end 53 of the carton. The first and second circular handle flap 137, 139 may be pressed inward to create a circular opening 147 in the overlapped end flaps 14, 50 at the second end 53 of the carton. The handle 11 is shaped so that multiple fingers of a user may be placed in the elongate opening 145 in the overlapped top panels 10, 46 and the thumb of a user may be placed in the circular opening 147 in the overlapped end flaps 14, 50.

Figure 9:
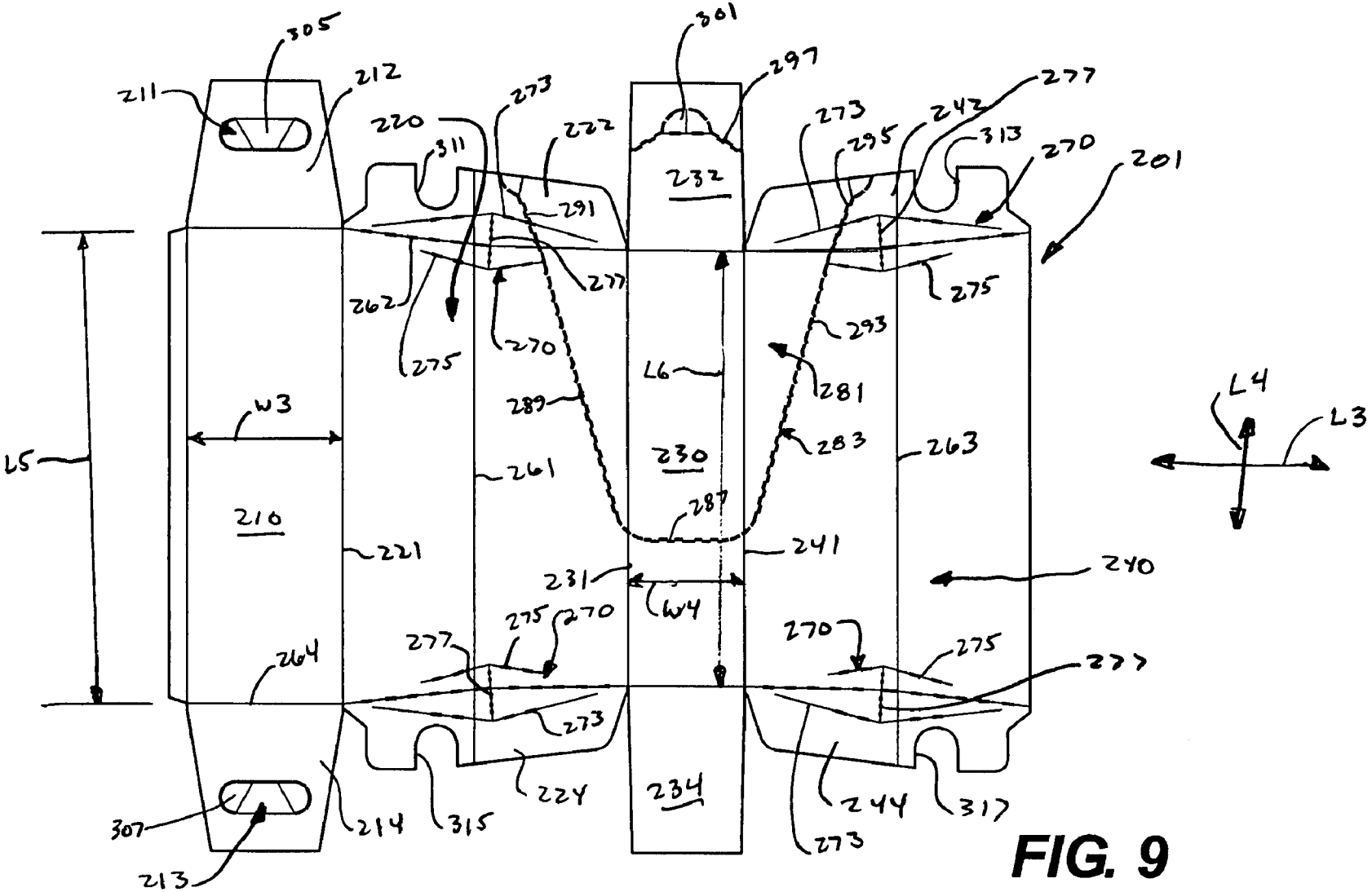
FIG. 9 is a plan view of a blank used to form a carton according to a second embodiment of the invention.
Figure 10:
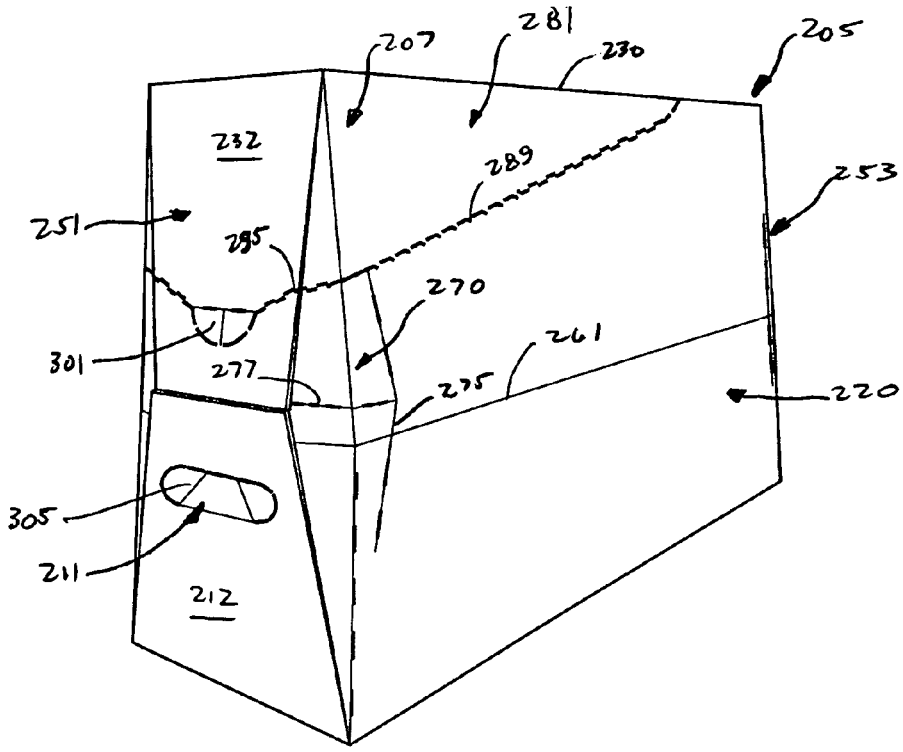
FIG. 10 is a perspective of the assembled carton of the second embodiment.

FIG. 9 shows a second embodiment of a blank 201 of the present invention. The blank 201 can be used to form a carton 205 (FIGS. 10-14) having tapered side walls 220, 240 similar to the carton 5 of the first embodiment. The carton 205 has first and second ends 251, 253 that are tapered to restrain the cartons in the container. The carton 205 has a dispenser 207 at the first end 251 of the carton for dispensing containers C from the carton, a first handle 211 at the first end of the carton for grasping and carrying the carton, and a second handle 213 at the second end of the carton for grasping and carrying the carton.

The blank 201 has a longitudinal axis L3 and a lateral axis L4. A bottom panel 210 is foldably connected to the first side panel 220 at a first lateral fold line 221. A top panel 230 is foldably connected to the first side panel 220 at a second lateral fold line 231, and foldably connected to the second side panel 240 at a third lateral fold line 241. The bottom panel 210 is foldably connected to a first bottom end flap 212 and a second bottom end flap 214. The first side panel 220 is foldably connected to a first side flap 222 and a second side flap 224. The top panel 230 is foldably connected to a first top end flap 232 and a second top end flap 234. The second side panel 240 is foldably connected to a first side flap 242 and a second side flap 244. When the carton 205 is erected, the end flaps 212, 232 and side flaps 222 and 242 close the first end 251 of the carton, and the end flaps 214, 234 and side flaps 224 and 244 close the second end 253 of the carton. In accordance with an alternative embodiment of the present invention, different flap arrangements can be used for closing the ends 251, 253 of the carton 205.

The end flaps 212 and 232 and side flaps 222 and 242 extend along a first marginal area of the blank 201, and are foldably connected at a first longitudinal fold line 262 that extends along the length of the blank. The end flaps 214 and 234 and side flaps 224 and 244 extend along a second marginal area of the blank 201, and are foldably connected at a second longitudinal fold line 264 that also extends along the length of the blank. The longitudinal fold lines 262, 264 may be, for example, substantially straight, or offset at one or more locations to account for blank thickness or for other factors.

The blank 201 has a lateral fold line 261 extending through side flap 222, first side panel 220, and side flap 224 so that each of these flaps and panels may be folded along the fold line 261 to have an upper portion that tapers inward relative to a lower portion. A lateral fold line 263 extends through the side flap 242, second end panel 240, and side flap 244 so that each of these flaps and panels may be folded along the fold line 263 to have an upper portion that tapers inward relative to a lower portion.

The blank 201 includes four diamond-shaped corners, generally indicated at 270 that allow the side panels 220, 240 and ends 251, 253 of the carton 205 to angle inward toward the interior of the carton 205. In the embodiment of FIG. 9, each diamond-shaped corner 270 comprises opposed v-shaped fold lines 273, 275 spaced apart from a respective longitudinal fold line 262, 264 that are connected by a transverse fold line 277.

Figure 12:
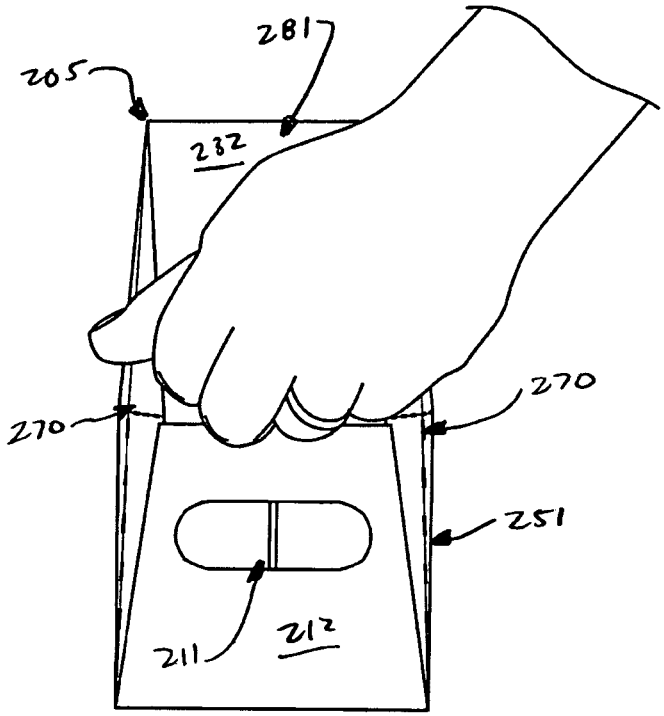
FIG. 12 is an end elevation showing activation of a dispenser panel of the second embodiment.
Figure 13:
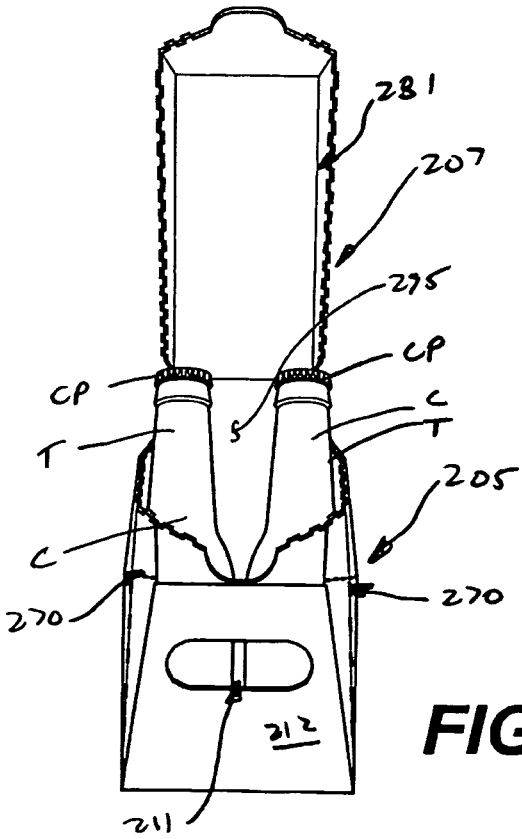
FIG. 13 is an end elevation of the second embodiment showing the dispenser panel in the open position.
Figure 14:
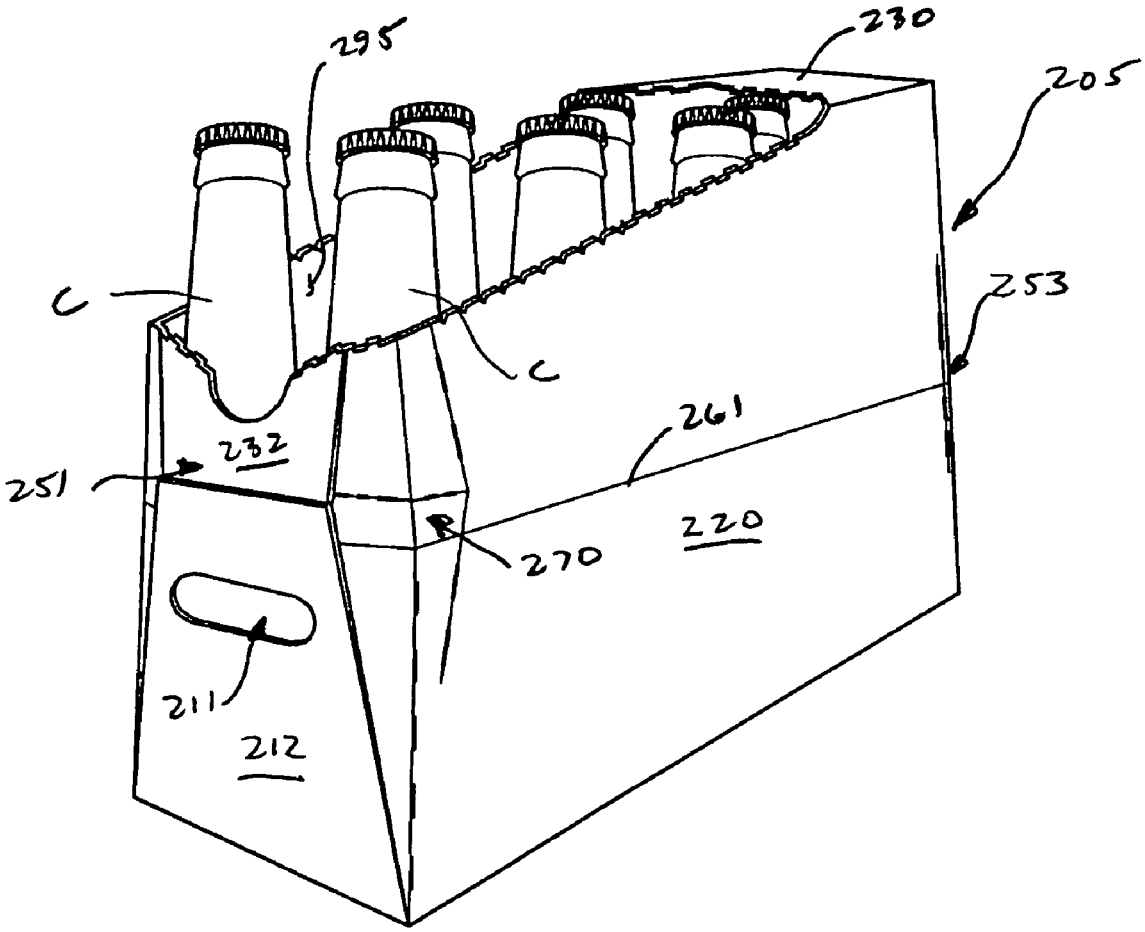
FIG. 14 is a perspective of the second embodiment showing the dispenser panel removed.

The dispenser 207 includes a dispenser panel 281 formed in the top panel 230, side panels 220, 240 and side flaps 222, 242. The dispenser panel 281 is separable from the carton 205 along a tear line, generally indicated at 283, to form an opening 285 (FIGS. 13 and 14) in the carton. The tear line 283 includes a first portion 287 that is in the top panel 230 and extends generally in the longitudinal direction of the blank 201, a second portion 289 extending obliquely from the lateral fold line through the side panel 220 to the longitudinal fold line 262, a third portion 291 extending obliquely from the longitudinal fold line through the side panel 222 to the edge of the side panel, a fourth portion 293 extending obliquely from the lateral fold line 241 through the second side panel 240 to the lateral fold line 262, a fifth oblique portion 295 extending from the longitudinal fold line through the side panel 242 to the edge of the side panel, and a sixth portion 297 that is in the top end flap 232 and is shaped to form a finger panel 301 at the first end 251 of the carton. As shown in FIGS. 12-14, the dispenser 207 may be activated by grasping the dispenser panel 281 at the finger panel 301 and tearing the dispenser panel along the tear line 283 to remove the dispenser panel and expose the top portion T of the containers C in the carton 205. The containers C may be dispensed from the carton by removing the containers through the opening 295 in the carton 205.

The first handle 211 at the first end 251 includes an elongate handle flap 305 in the bottom end flap 212, and the second handle 213 at the second end 253 includes an elongate handle flap 307 in the bottom end flap 214. The first handle 211 includes respective curved cutouts 311, 313 in the end flaps 222, 242 to allow the elongate handle flap 305 to fold inwardly when the handle is activated. The second handle 213 includes respective curved cutouts 315, 317 in the end flaps 224, 244 to allow the elongate handle flap 307 to fold inwardly when the handle at the second end 253 of the carton 205 is activated.

Figure 11:
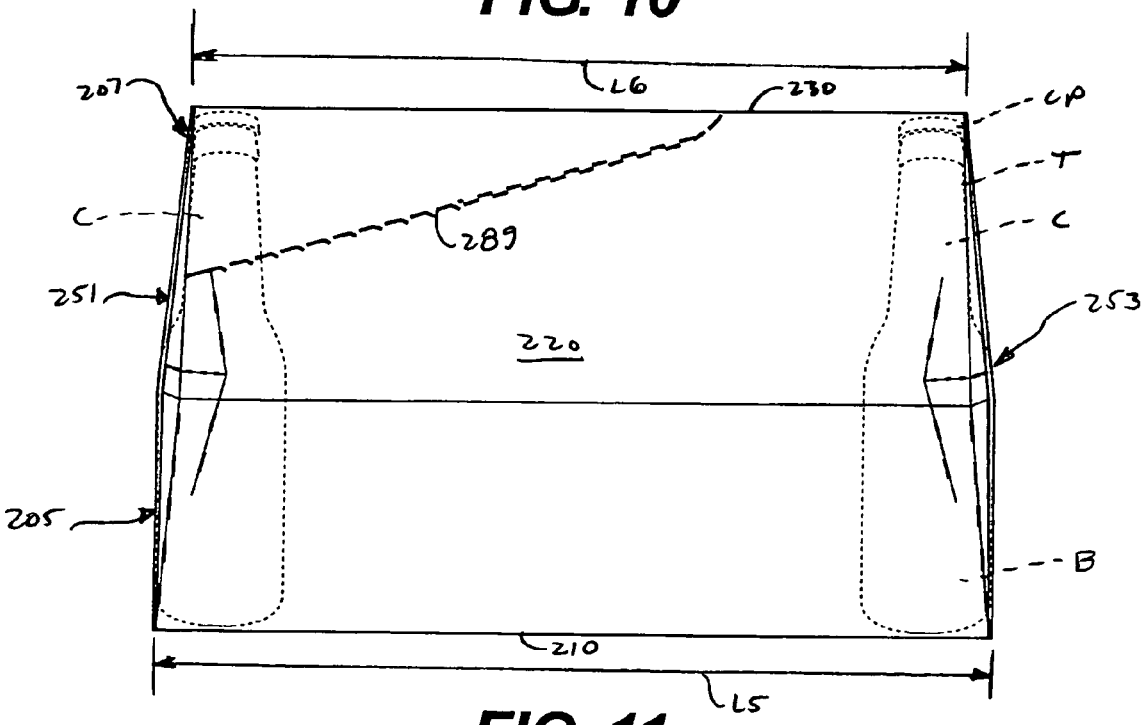
FIG. 11 is a side elevation of the carton of the second embodiment.

The bottom panel 210 of the blank 201 has a width W3 and a length L5 less than a respective width W4 and length L6 of the top panel. As with the first embodiment, the narrower width of the top panel 230 than the bottom panel 210 causes the side panels 220, 240 to taper so that the bottom of the side panel are spaced further apart than the top of the side panels. The tapered side panels 220, 240 allow the carton 205 to contact the containers C at both the bottom B and top T. As shown in FIG. 11, the shorter length of the top panel 230 as compared to the bottom panel 210 causes both ends 251, 253 of the carton 205 to be shaped to contact both the top T and bottom B of the containers C housed in the carton to restrain the movement of the containers in the carton. In one exemplary embodiment, the width W3 of the bottom panel 210 is approximately 5.0 inches (126 mm), the length L5 of the bottom panel is approximately 14.8 inches (380 mm), the width W4 of the top panel 230 is approximately 3.7 inches (94 mm), and the length L6 of the top panel is approximately 13.7 inches (349 mm). In general, the ratio of the width W4 of the top panel 230 to the width W3 of the bottom panel 210 may be in the range of approximately 0.7 to 1, and the ratio of the length L6 of the top panel to the length L5 of the bottom panel may be in the range of approximately 0.7 to 1. It is understood that the dimensional information presented herein is exemplary only and is not intended to limit the scope of the present invention.

Figure 15:
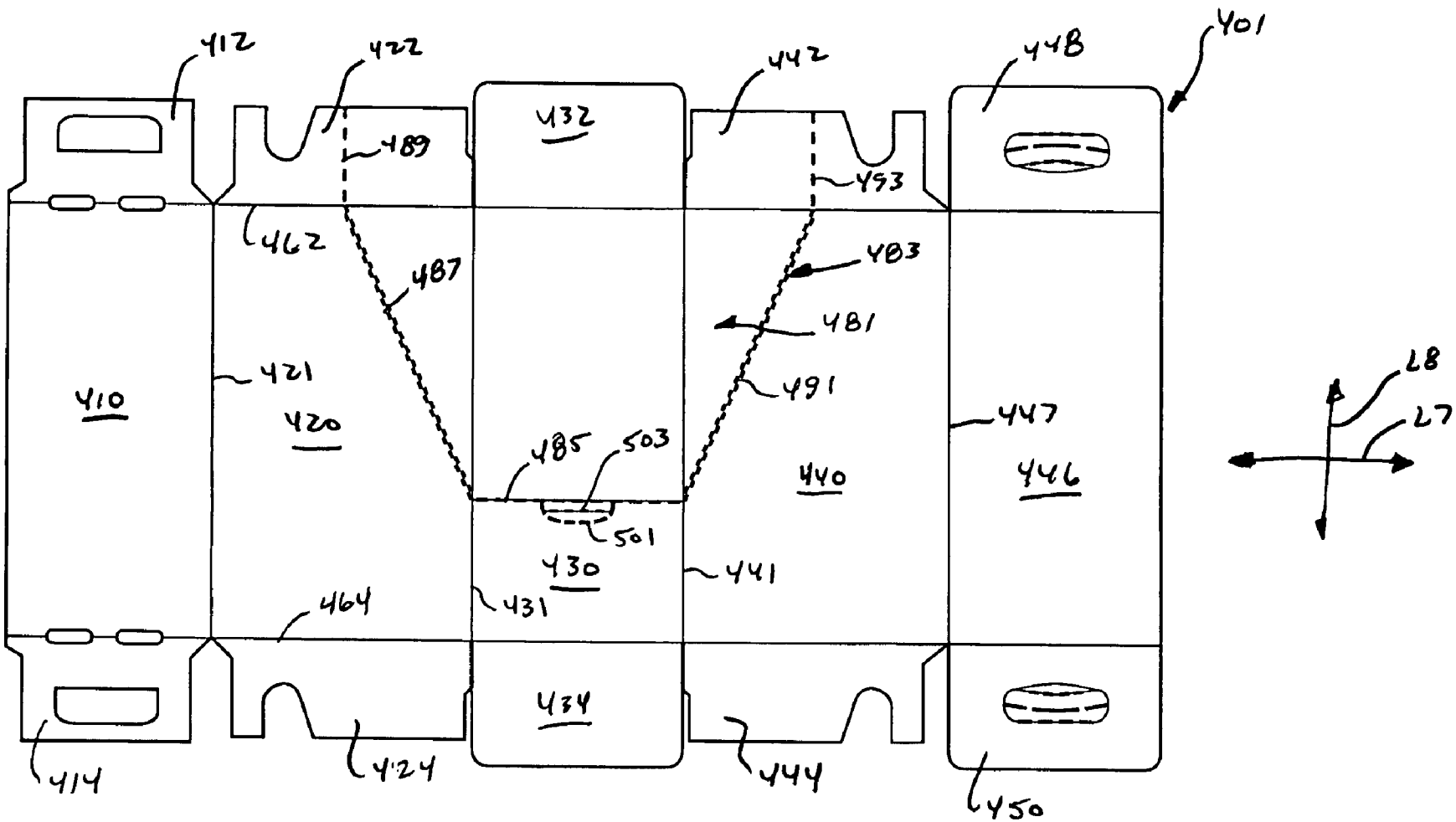
FIG. 15 is a plan view of a blank used to form a carton according to a third embodiment of the invention.

FIG. 15 shows a third embodiment of a blank 401 of the present invention. The blank 401 can be used to form a carton 405 (FIGS. 16-17) sized to hold containers C arranged in a 3×6 arrangement. The carton 405 has planar side walls 420, 440 and planar first and second ends 451, 453. The carton 405 has a dispenser 407 at the first end 451 of the carton for dispensing containers C from the carton. A first handle 411 is at the first end of the carton for grasping and carrying the carton, and a second handle 413 is at the second end 353 of the carton for grasping and carrying the carton.

Figure 16:
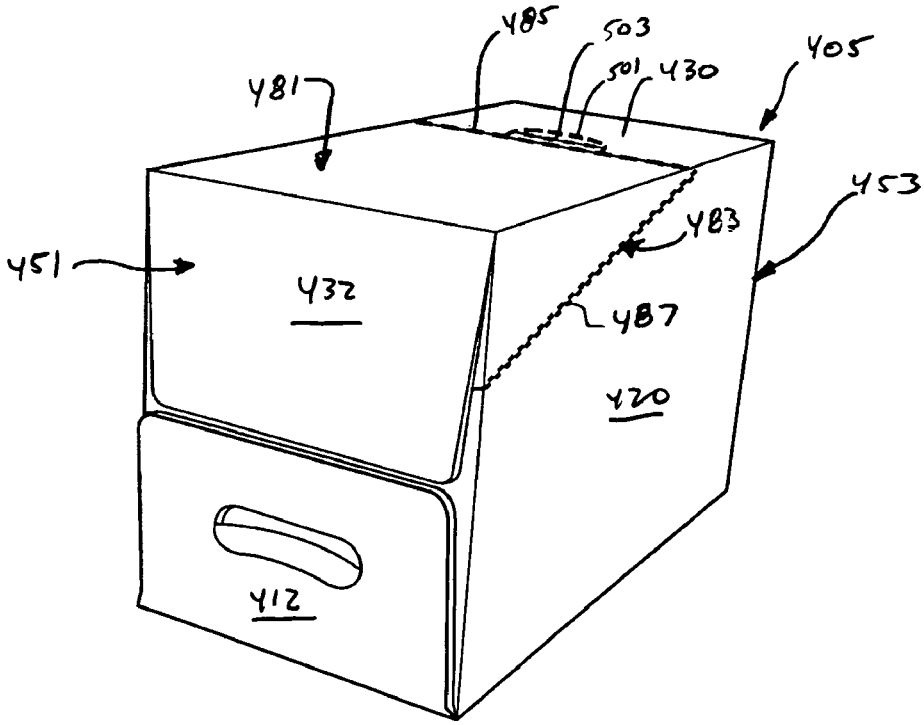
FIG. 16 is a perspective of the carton of the third embodiment.

The blank 401 has a longitudinal axis L7 and a lateral axis L8. A first bottom panel 410 is foldably connected to a first side panel 420 at a first lateral fold line 421, a top panel 430 is foldably connected to the first side panel 420 at a second lateral fold line 431, a second side panel 440 is foldably connected to the top panel 430 at a third lateral fold line 441, and a second bottom panel 446 is foldably connected to the second side panel at a fourth lateral fold line 447. The bottom panel 410 is foldably connected to a first bottom end flap 412 and a second bottom end flap 414. The first side panel 420 is foldably connected to a first side flap 422 and a second side flap 424. The top panel 430 is foldably connected to a first top end flap 432 and a second top end flap 434. The second side panel 440 is foldably connected to a first side flap 442 and a second side flap 444. The second bottom panel 446 is foldably connected to a first bottom end flap 448 and a second bottom end flap 450. When the carton 405 is erected, the end flaps 412, 432, 448 and side flaps 422 and 442 close the first end 451 of the carton, and the end flaps 414, 434, 450 and side flaps 424 and 444 close the second end 453 of the carton. In accordance with an alternative embodiment of the present invention, different flap arrangements can be used for closing the ends 451, 453 of the carton 405. The end flaps 412, 432, 448 and side flaps 422 and 442 are foldably connected at a first longitudinal fold line 462 that extends along the length of the blank. The end flaps 414, 434, 450 and side flaps 424 and 444 are foldably connected at a second longitudinal fold line 464 that also extends along the length of the blank. In the embodiment of FIGS. 15-16, the longitudinal fold lines 462, 464 are substantially straight, but the fold lines 462, 464 could be otherwise configured without departing from the scope of this invention.

Figure 17:
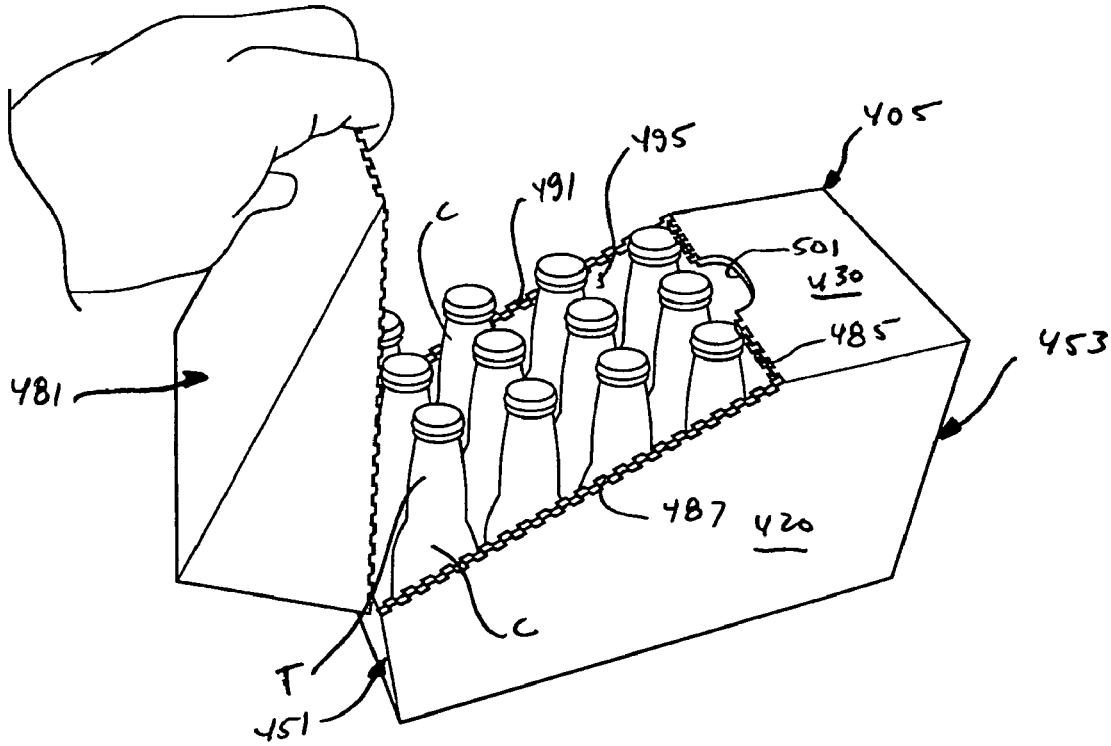
FIG. 17 is a perspective of the carton of the third embodiment with a dispenser panel in the open position.

The dispenser 407 includes a dispenser panel 481 that is separable from the blank 401 at a tear line, generally indicated 483, to form an opening 495 in the carton 405 (FIG. 17). The tear line 483 includes a first portion 485 in the top panel, a second oblique portion 487 in the first side panel 420, a third longitudinal portion 489 in the end flap 422, a fourth oblique portion 491 in the second side panel 440, and a fifth longitudinal 493 portion in the end flap 442. The first portion 485 of the tear line includes a curved portion 501 that defines a finger panel 503 in the top panel 430 of the carton 405. As shown in FIG. 17, the dispenser panel 481 is removed from the carton 405 by grasping the finger panel 503 and separating the dispenser panel from the carton along the tear line to expose the top portion T of at least some of the containers C housed in the carton 305.

In the embodiment of FIGS. 15-17, the top panel 430 and the bottom panels 410, 446 have approximately the same length and width so that the side walls 420, 440 and the ends 451, 453 of the carton 450 are each substantially planar. It is understood that the carton 405 could be modified so that one or more of the side walls 420, 440 and ends 451, 453 are tapered as described above for the previous embodiments.

The blank according to the present invention can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described above. The blank can also be laminated to or coated with one or more sheet-like materials at selected panels or panel sections.

In accordance with the above-described embodiments of the present invention, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present invention for each of the tear lines to be replaced with a continuous slit, or the like. For example, a cut line can be a continuous slit or could be wider than a slit without departing from the present invention.

The above embodiments may be described as having one or more panels adhered together by glue during erection of the carton embodiments. The term "glue" is intended to encompass all manner of adhesives commonly used to secure carton panels in place.

The foregoing description of the invention illustrates and describes the present invention. Additionally, the disclosure shows and describes only selected embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed is:

1. A carton for containing a plurality of articles, the carton comprising:

panels that extend at least partially around an interior of the carton, the panels comprise a top panel, a bottom panel, a first side panel foldably connected to the top panel at a first lateral fold line, and a second side panel foldably connected to the top panel at a second lateral fold line, where the bottom panel supports bottoms of the articles and the top panel is positioned adjacent tops of the articles;

at least two end flaps respectively foldably attached to respective panels of the plurality of panels, wherein the end flaps at least partially form a closed end of the carton, the at least two end flaps comprise a top end flap foldably attached to the top panel, a first side end flap foldably attached to the first side panel, and a second side end flap foldably attached to the second side panel, the top end flap, first side end flap, and second side end flap being respectively foldably attached to the top panel, first side panel, and second side panel at a longitudinal fold line; and a dispenser for allowing access to the articles in the carton, the dispenser comprising a dispenser panel that is at least partially defined by a tear line in the carton and is for being at least partially removed for at least further opening a dispenser opening, the tear line comprising a first portion in the top panel extending across an entire width of the top panel, between the first and second side panels, a second portion in the first side panel, a third portion in the second side panel, with at least one of the second and third portions of the tear line being oblique relative to the top panel and continuous with the first portion extending from one of the first lateral fold line and the second lateral fold line to the longitudinal fold line, and a portion in the top end flap.

2. The carton of claim 1 wherein both of the second and third portions of the tear line are oblique relative to the top panel.

3. The carton of claim 1 wherein the at least two end flaps comprise a first side end flap foldably attached to the first side panel and a second side end flap foldably attached to the second side panel, and the tear line comprises a fourth portion in the first side end flap and a fifth portion in the second side end flap.

4. The carton of claim 3 wherein the portion of the tear line in the top end flap is a sixth portion of the tear line.

5. The carton of claim 1 wherein the dispenser panel comprises a finger panel for grasping the dispenser panel and opening the dispenser.

6. The carton of claim 5 wherein the finger panel is foldably attached to at least one of the two end flaps.

7. The carton of claim 5 wherein the finger panel is foldably attached to the top panel.

8. The carton of claim 1 further comprising a handle for grasping and carrying the carton.

9. The carton of claim 1 wherein:

the end is a closed first end;

the end flaps are first end flaps that are overlapped with respect to one another to form the closed first end; and the carton further includes at least two second end flaps respectively foldably attached to respective panels of the plurality of panels that are overlapped with respect to one another to form a closed second end of the carton.

10. The carton of claim 9 further comprising a handle for grasping and carrying the carton, wherein the handle comprises an elongate flap generally adjacent the second closed end.

11. The carton of claim 10 wherein said elongate flap is foldably attached to the top panel and said handle further comprises a round flap in at least one of the second end flaps.

12. The carton of claim 11 wherein said second end flaps comprise a top end flap foldably attached to the top panel, a bottom end flap foldably attached to the bottom panel, a first side end flap foldably attached to the first side panel, and a second side end flap foldably attached to the second side panel, and wherein said round flap is foldably attached to the top end panel, and said handle comprises a first cutout in the first side end panel and a second cutout in the second side end panel for allowing said round flap to be folded toward the interior of the carton.

13. The carton of claim 10 wherein the handle is a first handle generally adjacent the first closed end, and the carton further comprises a second handle generally adjacent the second closed end.

14. The carton of claim 13 wherein the first handle comprises an elongate flap in at least one of the first end flaps, and the second handle comprises an elongate flap in at least one of the second end flaps.

15. The carton of claim 1 in combination with a plurality of articles, the plurality of articles comprising bottles that are arranged in an upright position in the carton for removal through the dispenser opening of the dispenser.

16. The carton of claim 1 wherein the top panel has a width less than a width of the bottom panel.

17. The carton of claim 16 wherein the top panel has a length less than a length of the bottom panel.

18. The carton of claim 1 wherein the top panel has a length and a width respectively substantially equal to a width and a length of the bottom panel.

19. A blank for forming a carton having a dispenser for dispensing articles from the carton, the blank comprising:

a plurality of panels comprising a top panel, a bottom panel, a first side panel foldably connected to the top panel at a first lateral fold line, and a second side panel foldably connected to the top panel at a second lateral fold line, where the bottom panel is for supporting bottoms of the articles and the top panel is for positioning adjacent tops of the articles when the blank is formed into the carton;

at least two end flaps respectively foldably attached to respective panels of the plurality of panels, wherein the end flaps at least partially form a closed end of the carton formed from the blank, the at least two end flaps comprise a top end flap foldably attached to the top panel, a first side end flap foldably attached to the first side panel, and a second side end flap foldably attached to the second side panel, the top end flap, first side end flap, and second side end flap being respectively foldably attached to the top panel, first side panel, and second side panel at a longitudinal fold line; and a dispenser panel at least partially defined by a tear line in the blank and at least partially separable from the blank along the tear line to form an opening of the dispenser, the tear line comprising a first portion that is in the top panel and extends across an entire width of the top panel, between the first and second side panels, a second portion in the first side panel, a third portion in the second side panel, with at least one of the second and third portions of the tear line being oblique relative to the top panel and continuous with the first portion extending from one of the first lateral fold line and second lateral fold line to the longitudinal fold line, and a portion in the top end flap.

20. The blank of claim 19 wherein both of the second and third portions of the tear line are oblique relative to the top panel.

21. The blank of claim 19 wherein the at least two end flaps comprise a first side end flap foldably attached to the first side panel and a second side end flap foldably attached to the second side panel, the tear line comprises a fourth portion in the first side end flap and a fifth portion in the second side end flap.

22. The blank of claim 21 wherein the portion of the tear line in the top end flap is a sixth portion of the tear line.

23. The blank of claim 19 further comprising a handle for grasping and carrying the carton.

24. The blank of claim 19 wherein:

the end flaps are first end flaps foldably connected to the panels at a longitudinal fold line at a first end of the blank; and the blank further includes at least two second end flaps respectively foldably attached to respective panels of the plurality of panels at a longitudinal fold line at a second end of the blank.

25. The blank of claim 24 further comprising a handle for grasping and carrying the carton formed from the blank, wherein the handle comprises an elongate flap generally adjacent the second end.

26. The blank of claim 25 wherein the elongate flap is foldably attached to the top panel and the handle further comprises a finger flap in at least one of the second end flaps.

27. The blank of claim 26 wherein the second end flaps comprise a top end flap foldably attached to the top panel, a bottom end flap foldably attached to the bottom panel, a first side end flap foldably attached to the first side panel, and a second side end flap foldably attached to the second side panel, and wherein said finger flap is foldably attached to the top end panel, and the handle comprises a first cutout in the first side end panel and a second cutout in the second side end panel.

28. The blank of claim 19 wherein the top panel has a width less than a width of the bottom panel.

29. The blank of claim 28 wherein the top panel has a length less than a length of the bottom panel.

30. The blank of claim 19 wherein the top panel has a length and a width respectively substantially equal to a width and a length of the bottom panel.

* * * * *